F3-201 SP
10/15/85 XR 4,546,597

United States Patent [19]

Denker

[11] Patent Number: 4,546,597

[45] Date of Patent: Oct. 15, 1985

[54] TRANSFER ASSEMBLY FOR LITERATURE WRAPPING EQUIPMENT

[75] Inventor: Stanley D. Denker, New Richmond, Wis.

[73] Assignee: Doboy Packaging Machinery, Inc., New Richmond, Wis.

[21] Appl. No.: 539,106

[22] Filed: Oct. 5, 1983

[51] Int. Cl.[4] ..... B65B 9/06; B65B 35/44; B65B 35/50

[52] U.S. Cl. ..... 53/540; 53/201; 53/550; 198/575; 198/579; 271/233; 271/271

[58] Field of Search ..... 53/201, 206, 460, 540, 53/550, 553; 198/459, 460, 461, 466, 575, 576, 577, 579; 271/233, 266, 269, 270, 271

[56] References Cited

U.S. PATENT DOCUMENTS 1,395,909 11/1921 Dellenbarger ..... 53/540 X 2,113,052 4/1938 Kemp ..... 271/271 X 3,706,370 12/1972 Bonafino et al. ..... 198/575

4,381,637 5/1983 Ballestrazzi et al. ..... 53/51

*Primary Examiner*—Robert L. Spruill

*Assistant Examiner*—Michael D. Folkerts

*Attorney, Agent, or Firm*—Orrin M. Haugen; Thomas J. Nikolai

[57] ABSTRACT

Apparatus having a plurality of controlled overlapping chain drives, each chain drive containing a plurality of raised members for receiving collated stacks of mailing literature and conveying the literature over their successive paths in synchrony with a collating assembly to a film wrapping assembly coupled at the opposite end thereof. Independently hinged overlying hold-down assemblies prevent the collating material from curling or otherwise becoming disassembled before wrapping in a film wrapper or in a paper wrapper.

7 Claims, 5 Drawing Figures

TRANSFER ASSEMBLY FOR LITERATURE WRAPPING EQUIPMENT

BACKGROUND OF THE INVENTION

The present invention relates generally to automatic, high-speed packaging machinery and, in particular, to a transfer conveyor assembly interfacing between a collator and either a polyfilm wrapping machine or an envelope stuffing machine.

With ever-increasing costs for direct mail advertising the charges for which are determined by the gross weight of the mailed literature, it becomes desirable to minimize the weight of the mailer within which the advertising literature is mailed. Heretofore, film wrapping equipment has been developed by Doboy Packaging Machinery, Inc. for appropriately enclosing the collated literature in a film envelope containing graphics that appropriately designates the addressor, addressee, as well as further advertising. The wrapper may also include transparent windows so as to highlight the contained literature. Collating equipment, such as the model A-297-6 manufactured and sold by the Phillipsburg Manufacturing Division of the Bell and Howell Corporation is available for appropriately arranging a number of pieces of literature to be mailed into separate stacks and which are later either manually or automatically stuffed into appropriate paper envelope. In that paper envelopes tend to be heavier than polyfilm wrappers, it is desirable that the collated material be wrapped in polyfilm in lieu of paper envelopes.

While the collator and polyfilm wrapping equipment have previously been developed, a problem has persisted in the development of a suitable assembly for interfacing between the above-mentioned equipment. The device coupling the collator to the wrapper should allow the option whereby the advertising matter may be appropriately film wrapped or, alternatively stuffed into a conventional paper envelopes without requiring extensive efforts to reconfigure the equipment. It is also necessary that a transfer assembly operate in synchronization with the associated collating and wrapping/stuffing equipment. Such synchronization becomes especially critical for a film wrapper, since in that case it is necessary that the collated matter be admitted relative to a preprinted and formed tube of polyfilm that is subsequently sealed and cut. If synchronization is not maintained, the printed matter is not properly aligned relative to the printed polyfilm and, thus, waste occurs. Also, it is necessary to maintain a high transfer rate without inducing curling or other disassembly of the collated and stacked matter.

These various objects are, however, achieved via the present transfer equipment which is comprised of a plurality of overlapping flights of chain drives, each having associated pushing members attached thereto for engaging the stacks of printed matter and transferring them at a controlled rate to the appropriate mailing wrapper. Synchronization is achieved between the collator and the transfer assembly by coupling collator drive to the transfer assembly and by initially spacing the pushing members of the primary transfer drive to accomodate the collation time of the stacks of printed matter.

The above objects, advantages and distinctions of the present equipment, as well as various others will, however, become more apparent upon reference to the following description thereof with respect to the following drawings. Before referring thereto, though, it is to be recognized that the following description is made only with respect to the presently preferred embodiment and, accordingly, various changes and modifications may be made thereto without departing from the spirit and scope of the present invention.

SUMMARY OF THE INVENTION

As already indicated, the present invention involves a transfer apparatus in combination with apparatus for collating a plurality of sheets of printed matter whereby the collated material is directed into an appropriate mailer, either a film wrapper or a paper wrapper. In accordance with the invention, the transfer assembly comprises a plurality of overlapping flights of chain drives, each having a plurality of pusher members attached to the chains for engaging and transferring the stacks of collated material from the collator to the wrapper. Synchronization between the collator and the film wrapper is achieved via the coupling of two interdependent continuous chain drives to an intermittent, clutch-coupled chain driven from the collator. Overlying retractable frame members ensure that the stacked materials do not become disturbed as they traverse the horizontal table through which various chain connected pushing members project.

DESCRIPTION OF THE PREFERRED EMBODIMENT

Figure 1:
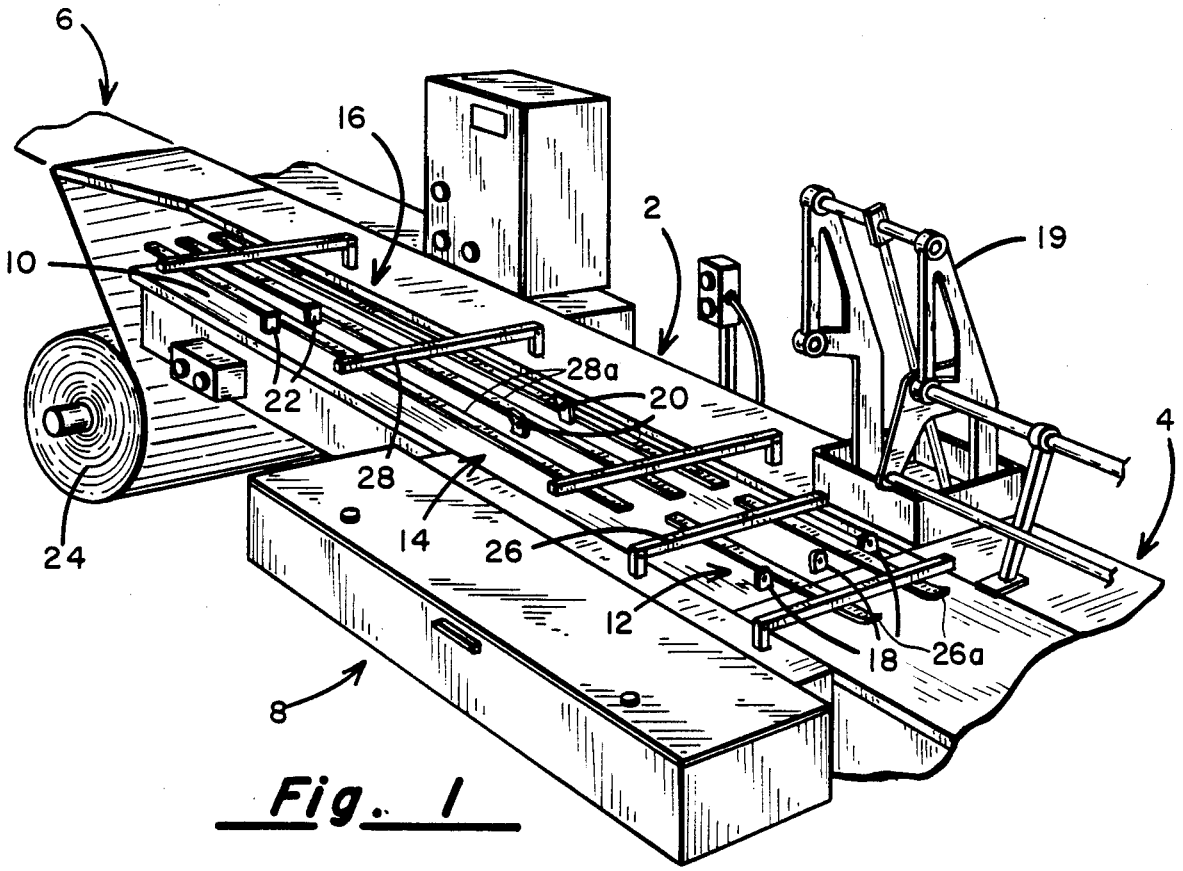
FIG. 1 shows a perspective view of the present transfer assembly relative to the collator, film wrapper and envelope stuffer.

Referring to FIG. 1, a perspective view is shown of the present transfer assembly 2 illustrating its relative location with respect to a conventional collator 4 mounted at the right end of the assembly 2 and a high-speed film wrapping machine 6 mounted at the left end of the assembly. A paper envelope stuffing apparatus 8 is shown positioned to the front side thereof, near the collator. The collating apparatus may be of any suitable type, but, at present, it is contemplated to be a model A-297-6 collator manufactured and sold by the Phillipsburg Manufacturing Division of the Bell and Howell Corporation. Similarly, the high-speed film wrapping machine may be a Doboy Literature Wrapper manufactured by Doboy Packaging Machinery, Inc. of New Richmond, Wis. The side mounted envelope stuffer 8 is also manufactured by the Phillipsburg Manufacturing Division. Thus, the present invention comprises a transfer assembly 2 adapted to the collator 4, film wrapper 6 and envelope stuffer 8 for permitting the selective placement of the collated material into either a film mailer or a conventional paper envelope.

Associated with the transfer assembly 2 is a horizontal transfer table 10 that contains a plurality of drive regions 12, 14 and 16 wherein slots are cut through the table 10 to allow a plurality of pushing members to project and to sequentially engage and move the collated material at an appropriate rate of speed and in an appropriate direction, relative to the desired mailer packaging device. If it is desired to place the collated material into a paper mailer, the advertising material is conveyed from the collator 4 by the three-fingered pushing members 18 to the middle of the region 12, where an overlying side discharge assembly 19 (only a portion of which is shown) acts to jog the collated material to the front (when viewed in FIG. 1) and into the envelope stuffing equipment 8. The equipment 8, in turn, acts to individually fold, open and stuff paper envelopes with the collated material, before wetting an adhesive sealer and sealing the envelopes.

Alternatively, if it is desired to instead wrap the collated material with a film wrapper, the material is engaged by the fingers 18 and pushed to the end of region 12 where the fingers 20 of a two-fingered chain drive separately engage the stacks of material as they arrive and convey them to the end of region 14 where the fingers 22 of a two-fingered chain drive engage the stacked material and feeds it into the film wrapper 6. Since most typically the film wrapper 24 of the stock equipment 6 contains printed matter and windows therethrough so as to expose the addressor and addressee information, it is necessary that the transfer of the stacks of material be such that a bottleneck does not occur at the collator 4 nor at the wrapper 6 and that the material delivered to the wrapper 6 be at a rate that ensures that the printing of the film wrapper 24 aligns with the collated contents. Thus, it is necessary that the present chain drive assemblies associated with the pusher fingers 18, 20 and 22 be synchronized with the respective collator 4 and wrapper 6 and that it provide a continuous midregion 14 that is sufficiently long so as to accomodate the fastest intermittent rate of the collator 4 and the slowest continuous rate of the film wrapper 6. The details thereof will, however, be described below.

Further, because it is necessary to maintain the printed matter in a tightly packed pile, overlying hold-down carriages 26 and 28 are provided which extend over regions 12 and 14 and 16. The hold-down carriages 26 and 28 are hinged so that they may be rotated upwardly and away from the feedpath to facilitate access to the stacks of printed matter, should this be necessary during operation. As the material is transferred, it is necessary that the fingers 18, 20 and 22 not disrupt the stacks of printed materials, while jogging them into neat, aligned piles. In the present invention, this alignment is achieved by using a plurality of different pushing members 18, 20 and 22 which are transversely mounted relative to one another so as to each engage different portions of the stacks of material, thereby repetitively jogging the material into a uniform vertical alignment, before packaging. Overlying members 26a, 28a mounted to the carriages 26 and 28 at the pickup points also frictionally engage the stacks and hold the top sheets in registry.

Figure 2:
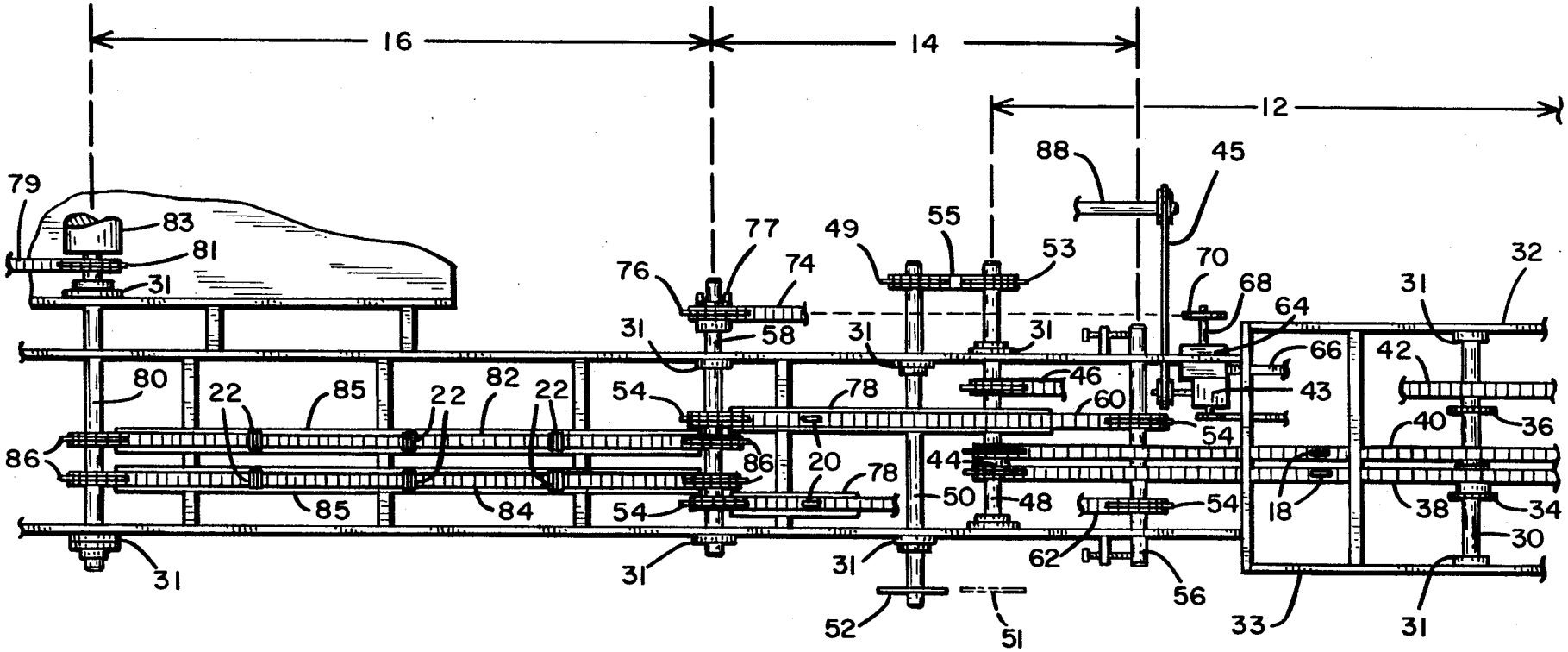
FIG. 2 shows a top plan view of the overlapping chain drives relative to the horizontal slide bed.

Referring next to FIG. 2, a top view is shown of the present transfer assembly 2 with the carriages 26 and 28 and portions of the table 10 removed so as to expose the underlying chain drives and their associated pushing members and rider bars. With reference in FIG. 2 to the chain drive region 12, it begins in the collator 4 at an idler axle (not shown) mounted upstream of drive axle 30. It is to be recognized, however, that the unseen idler axle for the drive region 12 is substantially the same as drive axle 30 which is supported by a pair of end mounted bearings 31 between the frame side members 32 and 33. Depending upon the type of mailer (i.e. paper or film) that is desired, either drive axle 30 assists in conveying the collated materials to the envelope stuffer 8 or the unseen idler axle is used to assist in conveying the collated materials to the wrapper 6, instead. Specifically, where a paper envelope is to be used, the sprocket pair 34 and 36 are clamped to the axle 30 to the right of the position shown and are coupled via chains (not shown) to the collator 4 so as to convey and deposit the stacked materials in the region adjacent to the side discharge assembly 19. There the discharge arms (not shown) are intermittently actuated so as to engage the materials and push them to the front (FIG. 1) and into the infeed to the envelope stuffing apparatus 8.

Alternatively, where a polyfilm wrapper is desired, the sprockets 34 and 36 are moved over to the left (FIG. 2) and out of the way and are reclamped to axle 30. Longer drive chains 38, 40 and 42 are then added and mounted about the associated sprockets on the idler axle (not shown) and are, in turn, connected to the forwardly mounted sprocket pair 44 and single sprocket 46 that are mounted on axle 48. Axle 48 thus becomes the drive axle, rather than drive axle 30. Each of the chains 38, 40 and 42, in turn, contain a plurality of normally projecting pushing members 18, which are typically spaced apart from one another by approximately 12-½ inches. The outermost pushers are taller than the center pusher members so that they can convey the collated materials past the side discharge assembly 19 to the conveyor region 14.

Drive power for the transfer assembly 2 is, obtained from the same motor (not shown) which drives the collator 4 and which is mounted thereunder. In particular, the motor coupled by a timing belt to the collator's gear box which contains a Horton air clutch and, thence, via a plurality of sprockets and interconnecting chains, gear boxes and shafts to the mating sprockets of drive regions 12 and 14. The details of these connections will become more apparent from the following discussion. At the same time the motor of the collator drives a separate 90° gear transfer unit 43 and the wrapper 6 via an intermediate shaft 88 and a timing belt 45 that are coupled to the unit 43. The wrapper, in turn, provides power to the drive region 16 of the conveyor. Thus, upon disengaging the air clutch, the collator 4 and the drive regions 12 and 14 may be disengaged from the wrapper 6. This facilitates the synchronization of each to the other.

Referring to drive region 12, it obtains its power from the chain 51 (coupled to a sprocket intermediate the collator gear box and both of which are not shown) which, is coupled to the sprocket 52 mounted on axle 50. Axle 50 transfers the power to axle 48 via sprockets 49 and 53 and the chain 55 coupled therewith. Power is thus transferred from the collator 4 to drive region 12 and the pusher member containing chains 38, 40 and 42. At this point, it should be noted, too, that this power is applied intermittently as the stacks of material are shifted through the collator so that the pusher members 18 are able to pick up each stack, through the entire length of the collator. During the initial set up, the sprockets on the unseen idler axle (which are similar to sprockets 34 and on axle 30) are unclamped and rotated so as to cause the pusher members 18 to engage the stacks of material at collation stations before they are reclamped. Thus, as the pusher member 18 pass each collation station, one or more pieces of literature is added to the underlying stack until each complete collated stack reaches the end of the drive region 12.

Once each stack of collated material passes through the drive region 12, it reaches the beginning of the conveyor region 14. There the pushing members 20, coupled to the chains 60 and 62 which pass around the sprockets 54 mounted on axles 56 and 58, rise from below the table 10 and collect the collated materials and convey them at a continuous rate to the next conveyor region 16. The power to operate the continuous drive region 14 is obtained via the 90° gear drive assembly 64 that is mounted beneath the axle 56 and which receives its power from a driven line shaft 66 from the collator 4. The gear drive 64, in turn, transfers the power via its output shaft 68 to sprocket 70 and thence to axle 58 via chain 74 and sprocket 76.

As mentioned, the drive to axle 58 and drive region 14 is continuous, whereas that to axle 50 and drive region 12 is intermittent. It, therefore, is necessary to time the pusher members 20 relative to the members 18 to ensure the proper pick up of the collated materials. This is achieved via the trans-torque clutch 77 that is mounted in conjunction with the axle 58 at sprocket 76 and which provides the operator the ability to disengage the drive to the axle 58 so that the pusher members 20 may be adjusted so as to rise from below the table 10 and pick up the collated materials just as the members 18 fall.

At this point, it is also to be noted that the pusher members 20 are spaced approximately 20 inches apart along the chains 60 and 62 and are each pivotally mounted to the chains via an associated pivot pin. The pushing members 20 are maintained in their upright position as the chain travels over the rider bars 78, while they pivot and fall away from the stacked materials as they revolve around the sprockets 54 on axle 58. The pivoting of each of the members 20 is assured due to the boring of a relief hole in the metallic member 20 so that the weight is less on the forward end, thus causing the member 20 to pivot about a hollow pivot pin and away from the stacked materials.

As the materials are deposited at the drive region 16, a transversely mounted pair of pushing members 22 rise from beneath the transfer assembly frame and continue to convey the stacked materials to the film wrapper 6 at yet another rate (which may or may not be the same as for region 14). The motive power to the transfer assembly 2 in region 16 is provided to the drive axle 80 from the wrapper 6 chain 79 and which couples to sprocket 81. The power is, in turn, transferred to the pusher members 22 through the chains 82 and 84 and which pass over the sprockets 86. The chains 82 and 84 carry the pushing members 22 and the stacked materials over the rider bars 85 and, eventually, deposit the stacked materials at the infeed to the film wrapper 6 at the axle 80. The film wrapper 6 then picks up each stack of materials and feeds it into a formed tube of film 24 which is successively sealed on one longitudinal side and at the ends and after which the ends are cut so as to define an individual mailer. The details thereof will, however, not be described but should information with respect thereto be desired, it may be obtained by referring to the various sales literature descriptive thereof and which is available from the present assignee.

At this point, it should be noted that the correct positional relationship of the stacked materials to the film wrapper is achieved via the clutch 83. Specifically, the clutch 83 provides the operator with the ability to disengage axle 80 from the wrapper 6 drive power so that the pusher members 22 can be adjusted to fall, just as the infeed to wrapper 6 engages the collated materials. This then ensures that the materials are in alignment with the printing on the film wrapper 24.

As previously mentioned, the drive power to the film wrapper 6 is obtained from the timing belt 45 and its associated 90° gear transfer unit 43. In particular, the collator 4 drives the transfer unit 43 and it, in turn, transfers power to the wrapper 6 via the timing belt 45 and transfer shaft 88.

Figure 3:
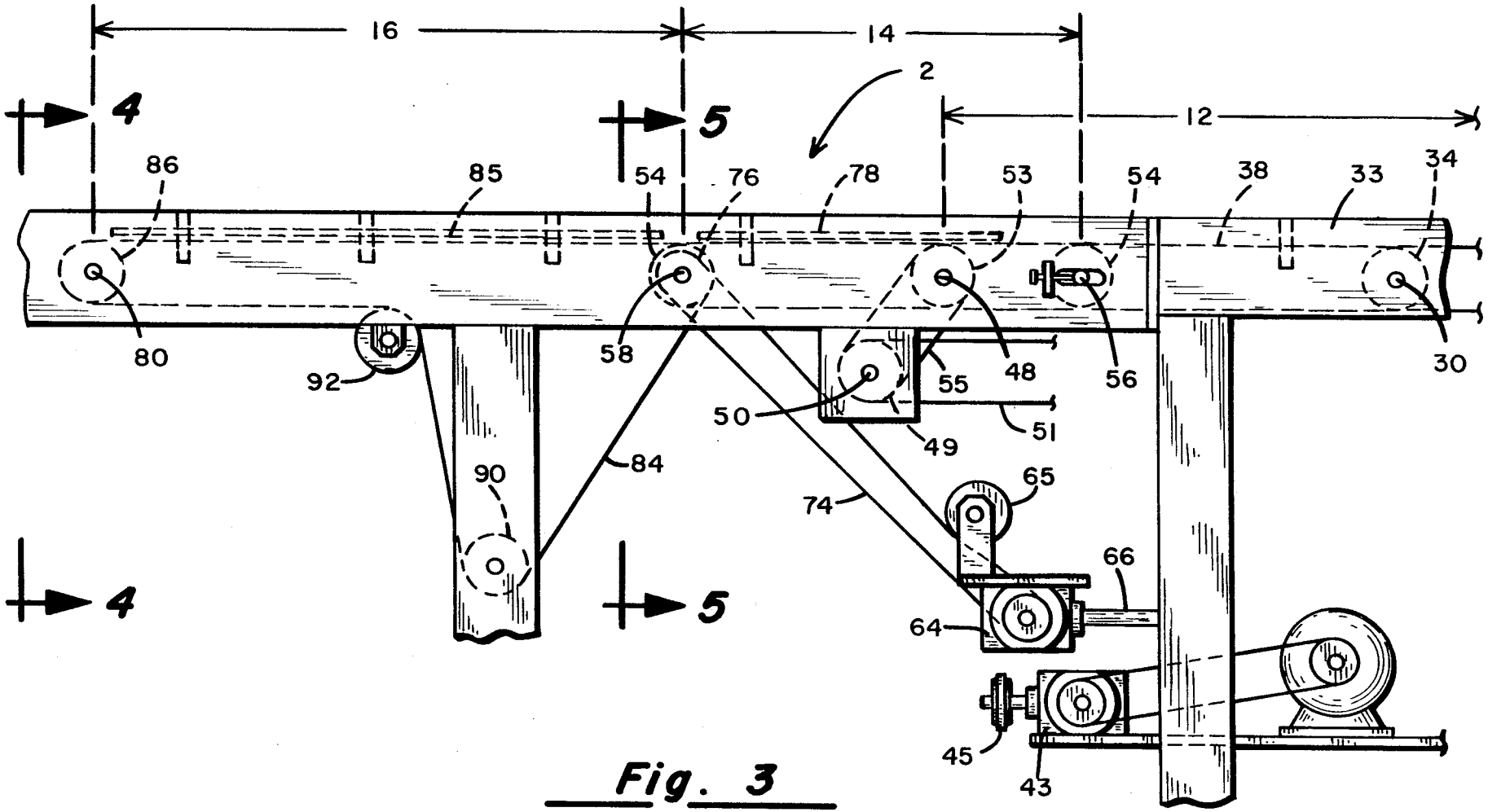
FIG. 3 shows a front elevation view of the present transfer assembly.

Directing attention now to FIG. 3, a front elevation view is shown of the transfer assembly 2 and the power coupling to the chain conveyors can more particularly be seen as well as the elevation of the various sprockets and the closed loop, endless paths of the chains. In the chain drive region 16, it can be seen that each of the chains 82 and 84 (although only chain 84 is shown) is looped about a plurality of sprockets and a roller. Specifically, the chain 84 is looped about the upper sprockets 86, a lower tensioning sprocket 90 and an intermediate roller 92 which coact to place a sufficient tension on the chain and to direct it so as to clear the various other structures of the present apparatus. The sprockets 86 mounted to axle 58 are also mounted on roller bearings, thereby isolating drive region 16 during the synchronizing of drive region 14, upon disengaging clutch 77.

Also seen in FIG. 3 is the right angle gear transfer unit 64 cooperating with chain 74 and axle 58. Mounted beneath the transfer unit 64 is the transfer unit 43 and its timing belt 45. The transfer unit 43 receives its drive power from the collator motor via a chain coupling (shown in phantom), while the transfer unit 64 receives power from a gear box (not shown) coupled to shaft 66. The drive to axle 50 comes from the chain 51 coupled to the collator 4 and a mating sprocket mounted (not shown) in the region beneath the envelope stuffer 8.

Figure 4:
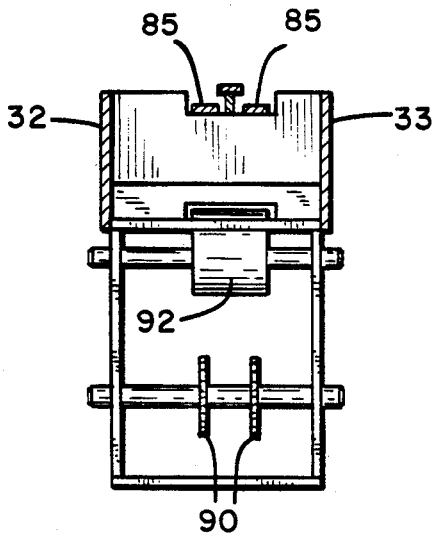
FIG. 4 shows an end view taken along lines 4—4 of FIG. 3.

Directing attention next to FIG. 4, the sprockets 90, roller 92 and rider bars 85 can be seen relative to their mounting to the side frames 32 and 33 of the transfer assembly 2.

Figure 5:
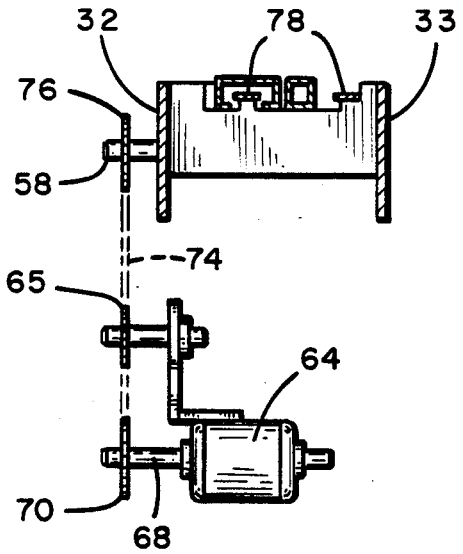
FIG. 5 shows an end view taken along lines 5—5 of FIG. 3.

FIG. 5 shows the power transfer that takes place relative to axle 58 and sprockets 76 via the intervening sprokets 65 and 70, chain 71 and right angled power take off 64. The sprocket 65 essentially acts as an idler or clearance and tensioning sprocket as the power is conveyed to sprockets 76 and 54 via chain 74. The rider bars 78 upon which the chains 60 and 62 travel in a continuous fashion are also shown relative to the frame.

From the above description and the drawings depictive of the present invention, it should be apparent that various modifications may be made to the present power transfer assemblies so as to ensure that power is appropriately delivered to the various conveyor regions. Additionally, other modifications may be made, without departing from the spirit and scope of the present invention. It is, accordingly, contemplated that to the extent such equivalent embodiments fall within the spirit and scope of the following claims, they should be interpreted to include such embodiments therein.

What is claimed is:

1. Apparatus for preparing a plurality of pieces of printed matter for mailing comprising in combination:

collating means for sequentially assembling into final stacks for mailing a plurality of different loose pieces of printed matter obtained from a plurality of individual stacks, each of said individual stacks

UNITED STATES PATENT AND TRADEMARK OFFICE

CERTIFICATE OF CORRECTION

PATENT NO. : 4,546,597

DATED : October 15, 1985

INVENTOR(S) : Stanley D. Denker

It is certified that error appears in the above-identified patent and that said Letters Patent are hereby corrected as shown below:

Column 7, Line 3, before "individual", the word -- said -- should be inserted.

Column 8, Line 16, after "region" the word -- chains -- should be inserted.

Signed and Sealed this

*Seventeenth* Day of *December 1985*

[SEAL]

*Attest:*

DONALD J. QUIGG

*Attesting Officer*

*Commissioner of Patents and Trademarks*